US009524840B2

(12) United States Patent
Birnie et al.

(10) Patent No.: US 9,524,840 B2
(45) Date of Patent: Dec. 20, 2016

(54) HIGH-TEMPERATURE, HIGH-PRESSURE VACUUM RELAY

(71) Applicant: Thomas & Betts International, LLC, Wilmington, DE (US)

(72) Inventors: Jason Birnie, Sunnyvale, CA (US); Jose Frias, San Jose, CA (US); Susanne Geiss, Felton, CA (US)

(73) Assignee: Thomas & Betters International LLC, Wilmington, DE (US)

( * ) Notice: Subject to any disclaimer, the term of this patent is extended or adjusted under 35 U.S.C. 154(b) by 0 days.

(21) Appl. No.: 14/972,576

(22) Filed: Dec. 17, 2015

(65) Prior Publication Data

US 2016/0211098 A1 Jul. 21, 2016

Related U.S. Application Data

(60) Provisional application No. 62/105,862, filed on Jan. 21, 2015.

(51) Int. Cl.

| | |
|---|---|
| ***H01H 33/66*** | (2006.01) |
| ***H01H 51/04*** | (2006.01) |
| ***H01H 11/00*** | (2006.01) |
| ***H01H 51/28*** | (2006.01) |
| ***H01H 33/662*** | (2006.01) |
| ***H01H 50/02*** | (2006.01) |
| *H01H 50/04* | (2006.01) |

(52) U.S. Cl.

CPC ..... *H01H 51/04* (2013.01); *H01H 11/00* (2013.01); *H01H 33/662* (2013.01); *H01H 50/023* (2013.01); *H01H 51/28* (2013.01); *H01H 51/281* (2013.01); *H01H 51/282* (2013.01); *H01H 50/041* (2013.01); *H01H 2033/6623* (2013.01)

(58) Field of Classification Search

CPC ..... H01H 11/00; H01H 33/662–2033/6623

See application file for complete search history.

(56) References Cited

U.S. PATENT DOCUMENTS

| | | | |
|---|---|---|---|
| 3,161,843 | A | 12/1964 | Hodges et al. |
| 3,434,087 | A | 3/1969 | Hofmann |
| 3,757,263 | A | 9/1973 | Saarem et al. |

(Continued)

OTHER PUBLICATIONS

"Vacuum Relays Switching Characteristics," Jennings Technology, accessed Aug. 7, 2014, http://www.jenningstech.com/technotes/charactr.shtml.

*Primary Examiner* — Ramon M Barrera

(74) *Attorney, Agent, or Firm* — Taft Stettinius & Hollister LLP

(57) ABSTRACT

A relay assembly includes a switch body, an adaptor sleeve, a feed-through base, and an encapsulating resin. The switch body includes a flange extending orthogonally from a portion of a housing and leads. The adaptor sleeve is substantially cylindrical with apertures in the sleeve wall. A first end of the adaptor sleeve encircles at least a portion of the switch body and is attached to the flange. The feed-through base is attached to a second end of the adaptor sleeve to enclose the second end and includes holes through which conductors extend; contacts, inside the adaptor sleeve, joining each conductor to one of the leads; and insulators through which each conductor extends. The flange, adaptor sleeve, and feed-through base form an envelope around the portion of the housing, the contacts, and the leads. The resin fills the envelope and encapsulates the portion of the housing, the contacts, and the leads.

20 Claims, 10 Drawing Sheets

(56) References Cited

U.S. PATENT DOCUMENTS

| | | | |
|---|---|---|---|
| 4,039,984 | A | 8/1977 | DeLucia et al. |
| 4,082,916 | A | 4/1978 | Jaklic, Jr. et al. |
| 4,168,480 | A | 9/1979 | De Lucia |
| 4,206,436 | A | 6/1980 | Grunert et al. |
| 4,243,623 | A | 1/1981 | Sprengling et al. |
| 4,578,660 | A | 3/1986 | Hanada et al. |
| 4,594,644 | A | 6/1986 | Painter |
| 4,631,230 | A | 12/1986 | Torossian et al. |
| 4,803,028 | A | 2/1989 | Torossian et al. |
| 4,947,065 | A | 8/1990 | Ward et al. |
| 5,001,304 | A | 3/1991 | Hardin et al. |
| 5,554,963 | A | 9/1996 | Johler et al. |
| 5,734,125 | A | 3/1998 | Yasukuni et al. |
| 6,002,312 | A | 12/1999 | Dittmann et al. |
| 6,294,973 | B1 | 9/2001 | Kimura et al. |
| 7,321,281 | B2 | 1/2008 | Molyneux et al. |
| 7,990,240 | B2 | 8/2011 | Bush et al. |
| 8,350,645 | B2 | 1/2013 | Yeon |
| 8,446,240 | B2 | 5/2013 | Swartzentruber et al. |

HIGH-TEMPERATURE, HIGH-PRESSURE VACUUM RELAY

CROSS-REFERENCE TO RELATED APPLICATION

This application claims priority under 35 U.S.C. §119, based on U.S. Provisional Patent Application No. 62/105,862 filed Jan. 21, 2015, the disclosure of which is hereby incorporated by reference herein.

BACKGROUND OF THE INVENTION

The present invention relates to vacuum relays for high-voltage applications. Electromagnetic relays may be used for switching high electrical currents or high voltages. These relays typically have fixed and movable contacts with an actuating mechanism supported within a sealed chamber. Air is removed from the chamber using vacuum equipment, and the chamber is then sealed so that the fixed and movable contacts can contact/separate in a vacuum environment. Such high voltage relays have been used in a variety of environments. However, these vacuum relays cannot withstand extreme high-temperature, high-pressure environments.

DETAILED DESCRIPTION OF THE PREFERRED EMBODIMENTS

The following detailed description refers to the accompanying drawings. The same reference numbers in different drawings may identify the same or similar elements.

Conventional high-voltage relays cannot operate effectively in extreme high-pressure and high-temperature conditions. As used herein, extreme high-pressure conditions may include ambient pressures of up to 25,000 PSI (pounds per square inch) or higher and extreme high-temperature conditions may include temperatures of up to 200 degrees Celsius (C) or higher. Implementations described herein provide a high-voltage vacuum relay to enable the relay to operate in such extreme conditions. The coil of the vacuum relay is a high-temperature-resistant coil that can operate at extreme high-temperature conditions. The relay is then encapsulated using a high-temperature, high-pressure epoxy adhesive that is free of voids to deflect pressure away from the relay and allow proper functionality in extreme conditions.

Accord to one implementation, a relay assembly includes a switch body, an adaptor sleeve, a feed-through base, and an encapsulating resin. The switch body has a substantially cylindrical housing to house a coil and other internal switching components. The switch body includes a flange extending orthogonally from a portion of the housing, and multiple coil leads extending from an end of the cylindrical housing. The relay assembly also includes a substantially cylindrical adaptor sleeve with one or more openings in a wall of the sleeve. A first end of the adaptor sleeve encircles at least a portion of the switch body and is attached to the flange. The feed-through base is attached to a second end of the adaptor sleeve so as to enclose the second end of the adaptor sleeve. The feed-through base includes multiple holes through which a conductor extends from inside the adaptor sleeve to outside the adaptor sleeve; multiple contacts, inside the adaptor sleeve, joining each conductor to one of the multiple coil leads; and multiple insulators, adjacent to each of the multiple holes, through which each conductor extends. The flange, the adaptor sleeve, and the feed-through base form an envelope around the portion of the relay housing, the multiple contacts, and the multiple coil leads. The resin encapsulates the portion of the relay housing, the multiple contacts, and the multiple coil leads within the envelope.

Figure 1:
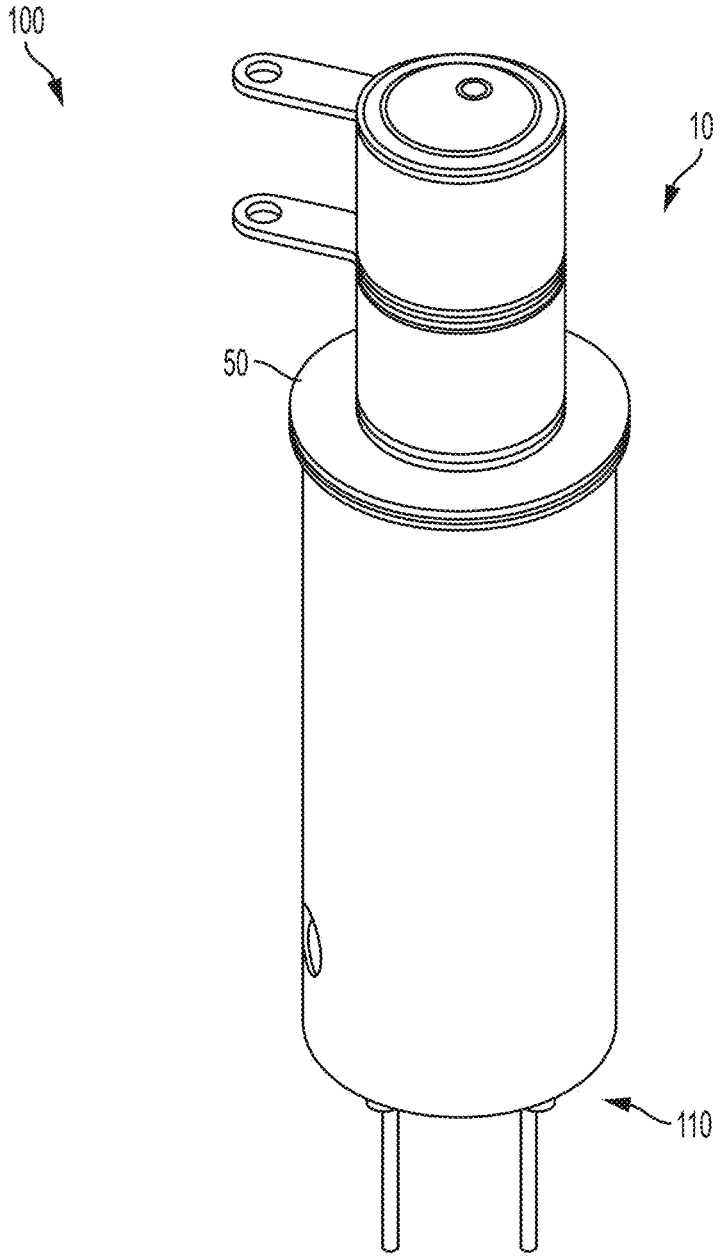
FIG. 1 is a schematic side perspective view of a high-temperature, high-pressure vacuum relay assembly according to an implementation described herein.

FIG. 1 provides a schematic side perspective view of a high-temperature, high-pressure vacuum relay assembly 100. As shown in FIG. 1, relay assembly 100 includes a switch body 10 that includes a flange 50. According to an implementation, switch body 10 is partially enclosed in a reinforcing sheath assembly 110.

Figure 2B:
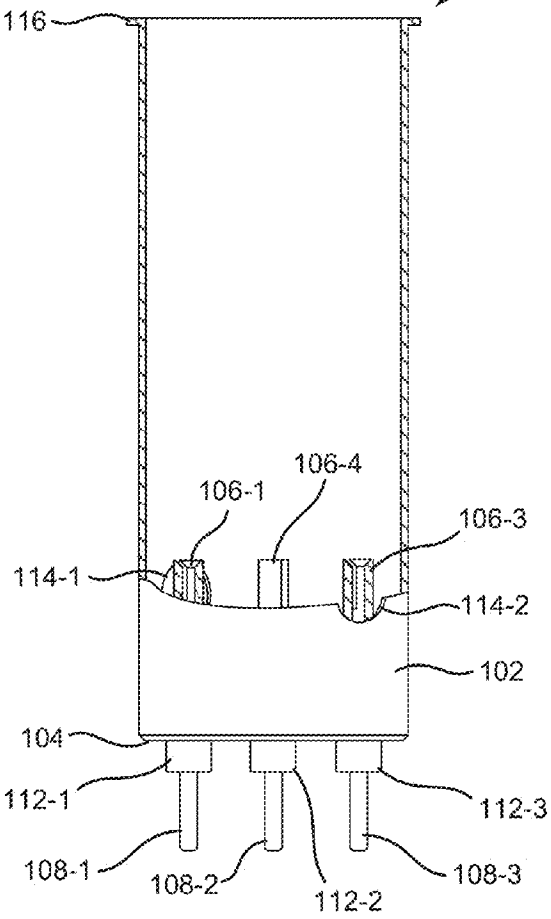
FIGS. 2A and 2B are a bottom view and a schematic partial cross-sectional view, respectively, of a reinforcing sheath assembly of the relay assembly of FIG. 1.
Figure 2A:
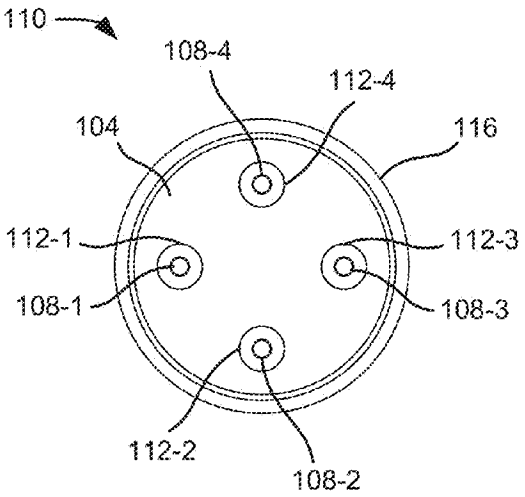

FIGS. 2A and 2B provide a bottom view and a schematic partial cross-sectional diagram illustrating reinforcing sheath assembly 110. As shown in FIGS. 2A and 2B, reinforcing sheath assembly 110 includes an adaptor sleeve 102, a feed-through base 104, multiple contacts 106-1 through 106-4 (referred to herein collectively as "contacts 106" and generically as "contact 106"), multiple conductors 108-1 through 108-4 (referred to herein collectively as "conductors 108" and generically as "conductor 108"), multiple insulators 112-1 through 112-4 (referred to herein collectively as "insulators 112" and generically as "insulator 112"), multiple apertures 114-1 and 114-2 in adaptor sleeve 102 (referred to herein collectively as "apertures 114" and generically as "aperture 114"), and a flange 116.

Adaptor sleeve 102 may generally form an open ended cylinder with flange 116 formed at one end and feed-through base 104 attached at the other end. Feed-through base 104 may be in the form of a disc and may be welded, brazed, or otherwise connected to adaptor sleeve 102 during production of relay assembly 100. In one implementation, adaptor sleeve 102 and feed-through base 104 may generally include strong, corrosion-resistant material with good weldability, such as a low-carbon grade stainless steel. In one example, adaptor sleeve 102 and feed-through base 104 may be made from American Iron and Steel Institute (AISI) grade 304L stainless steel.

Feed-through base 104 may include a plurality of holes through which conductors 108 may pass. Each conductor 108 may include a contact 106 that is positioned inside sheath assembly 110 (e.g., inside adaptor sleeve 102). Each contact 106 may be configured to receive leads (e.g., leads 60, FIGS. 3 and 4) from switch body 10. For example, each of contacts 106 may be designed to have a wiping fit on a standard-size lead (e.g., a 0.025 inch diameter lead) to provide an electrical connection from the lead to a corresponding conductor 108. The wiping fit may provide an electrical contact that provides motion beyond an initial touch point. Each contact 106 may have a flexible tubular contact causes the surface of contact 106 to wipe against a corresponding lead 60 as lead 60 is inserted. Each conductor 108 may include an electrically-conductive pin that extends from one of contacts 106 through feed-through base 104. In one implementation, contacts 106 and conductors 108 may be formed from strong, corrosion-resistant, electrically-conductive materials. In one example, contacts 106 may be formed from AISI grade 17-7 stainless steel, and conductors 108 may be formed from AISI grade 330 stainless steel.

Insulators 112 may be provided adjacent to each hole of feed-through base 104 where conductor 108 passes through. Each insulator 112 may prevent electrical contact between a respective conductor 108 and feed-through base 104. Each insulator 112 may be formed, for example, from a non-conductive glass/ceramic material, a polymer or plastic material, etc. In one implementation each insulator 112 may be brazed to feed-through base 104 adjacent to holes in feed-through base 104.

As described further herein, apertures 114 in adaptor sleeve 102 may provide an input port for epoxy resin and air outlet after sheath assembly 110 is attached to flange 50. Apertures 114 may generally be oriented between conductors 108 on opposite sides of adaptor sleeve 102 (e.g., 180 degrees apart). Flange 116 may generally extend laterally from the open end of adaptor sleeve 102 to provide a welding/brazing surface that can be attached to flange 50.

Figure 3:
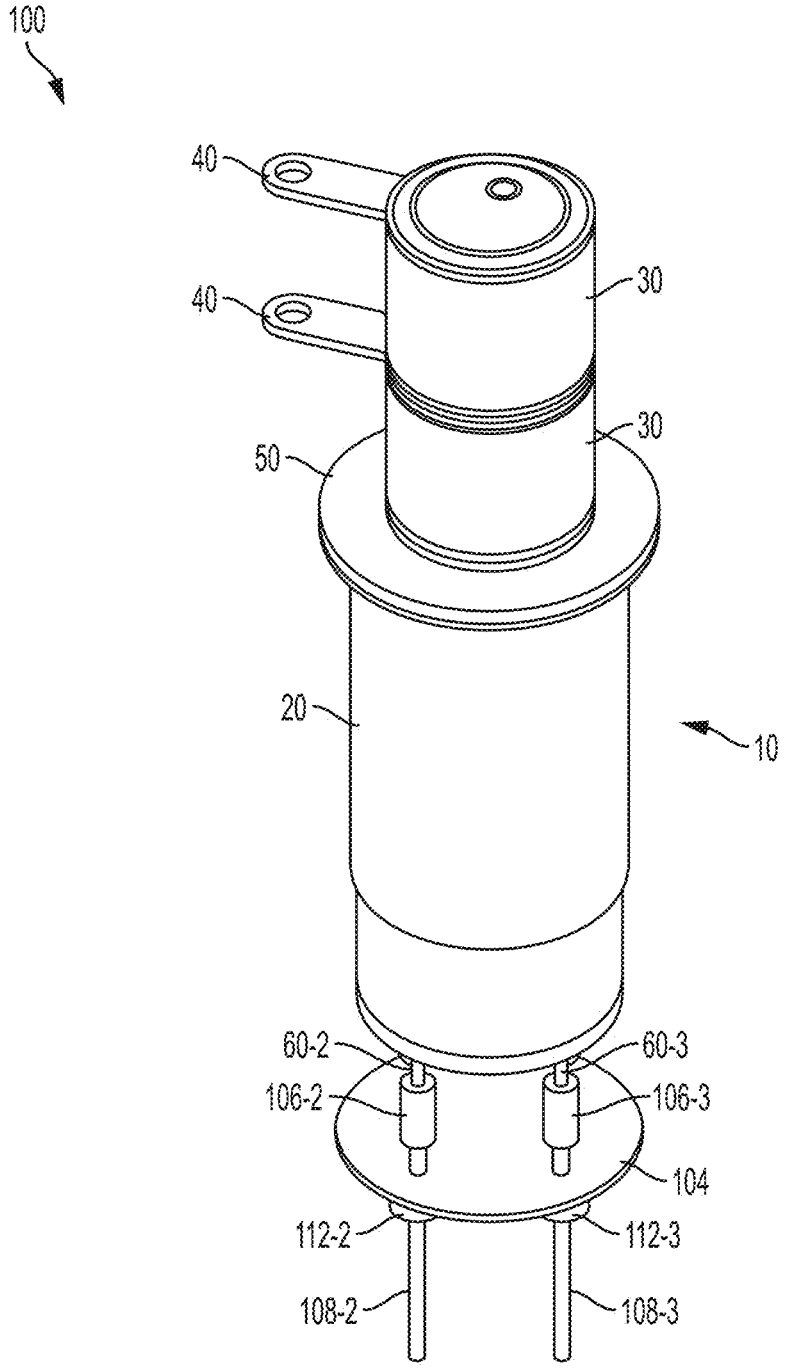
FIG. 3 is a schematic side perspective view of the relay assembly of FIG. 1 shown without an adaptor sleeve.
Figure 4:
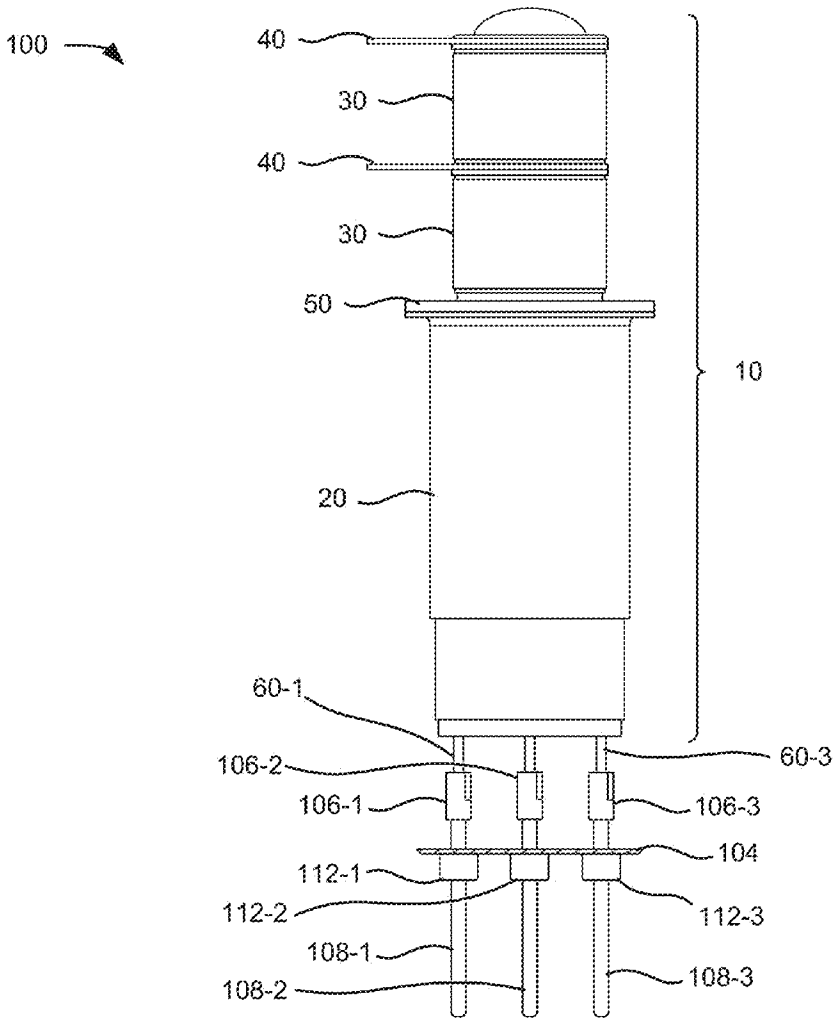
FIG. 4 is a schematic side view of the relay assembly of FIG. 1 shown without the adaptor sleeve.

FIG. 3 provides a schematic side perspective view of relay assembly 100 shown with adaptor sleeve 102 removed for clarity, and FIG. 4 provides a side view of relay assembly 100 also shown with adaptor sleeve 102 removed for clarity. Referring collectively to FIGS. 3 and 4, switch body 10 may include a coil housing 20, insulators 30, contacts 40, flange 50, and leads 60-1 through 60-4 (referred to herein collectively as "leads 60" and generically as "lead 60"). Coil housing 20 may enclose a magnetic actuating component (e.g., magnetic actuating component 22, FIG. 6). Coil housing 20 may be connected to one of insulators 30 at flange 50. Insulators 30 may enclose switching armatures and other components that selectively provide electrical connections with contacts 40 (e.g., normally open and/or normally closed contacts). Flange 50 may extend orthogonally outward beyond a diameter of coil housing 20 and/or insulators 30. Flange 50 may provide a point of attachment to join coil housing 20 with one of insulators 30. As described further below in connection with FIG. 5, flange 50 may also provide a point of attachment to mate with flange 116 of adaptor sleeve 102. Multiple leads 60 may extend from a bottom (e.g., as oriented in FIGS. 3 and 4) portion of coil housing 20. Contacts 106 of sheath assembly 110 may align with leads 60, such that each of contacts 106 may receive a corresponding lead 60.

Referring collectively to FIGS. 1-4, coil housing 20, insulators 30, flange 50, adaptor sleeve 102, and feed-through base 104 may be aligned along a common central axis. Adaptor sleeve 102 may generally be cylindrical in shape. Sheath assembly 110 may be open at one end of adaptor sleeve 102, where flange 116 extends orthogonally outward from adaptor sleeve 102. Feed-through base 104 may be attached at the other end of adaptor sleeve 102 to enclose one end of sheath assembly 110.

Sheath assembly 110 is configured to cover a lower portion of switch body 10. More particularly, adaptor sleeve 102 may encircle coil housing 20 and leads 60 of switch body 10. In one implementation, adaptor sleeve 102 may be slid over an end of coil housing 20 to bring flange 116 into contact with flange 50. Thus, sheath assembly 110 may be attached to flange 50 at flange 116. In one aspect, flange 116 may be brazed to flange 50. In another aspect flange 116 may be welded to flange 50.

Figure 5:
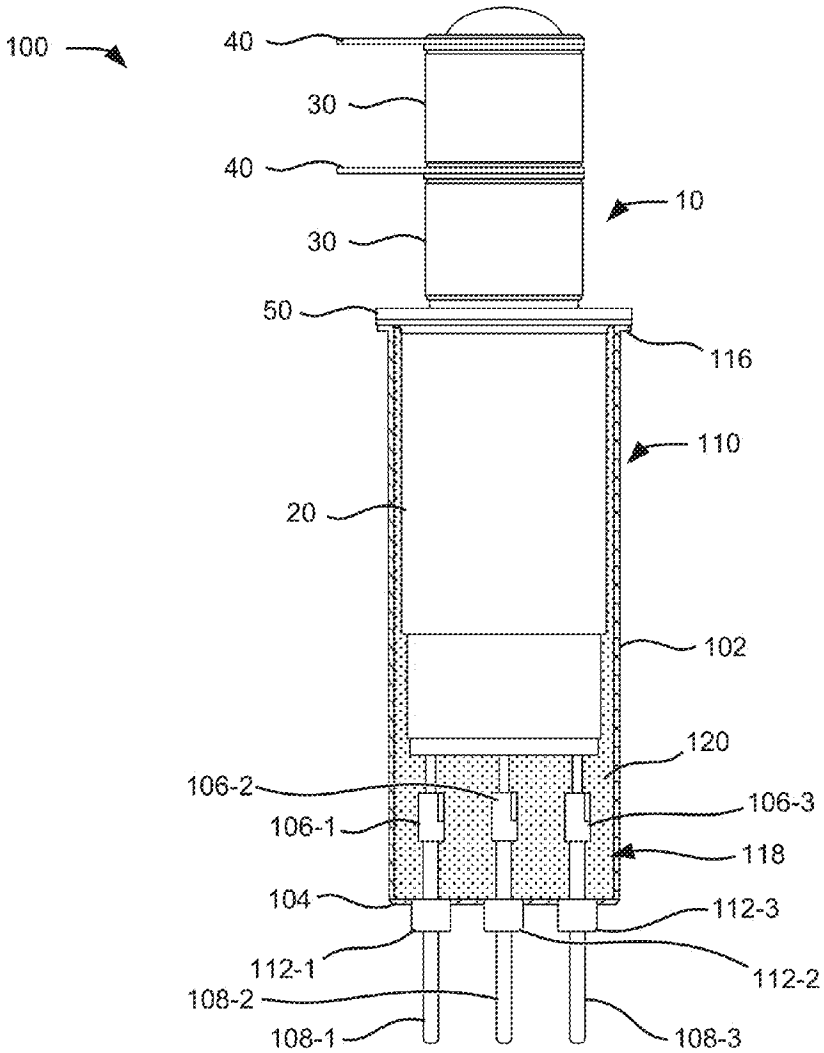
FIG. 5 is a schematic partial cross-sectional diagram illustrating a resin envelope of the relay assembly of FIG. 1.

FIG. 5 is a schematic partial cross-sectional diagram illustrating of relay assembly 100 showing an envelope 118. Sheath assembly 110 may form envelope 118 around coil housing 20, leads 60, contacts 106, and the portions of conductors 108 that do not extend through feed-through base 104. Envelope 18 may provides an area to encapsulate a portion of relay switch 10, leads 60, contacts 106, and/or conductors 108 in an epoxy resin within envelope 118. Envelope 118 may be open to air through apertures 114 (FIG. 2B). In configurations described herein, apertures 114 in adaptor sleeve 102 may be used to inject resin 120 into envelope 118. In one implementation, resin 120 (shown with a shaded pattern in FIG. 5) may include a thermoplastic polytherimide resin that, when injected and cured within envelope 118, can withstand high temperatures (e.g., of at least 200 degrees C.) and high pressures (e.g., of at least 25,000 psi).

Figure 6:
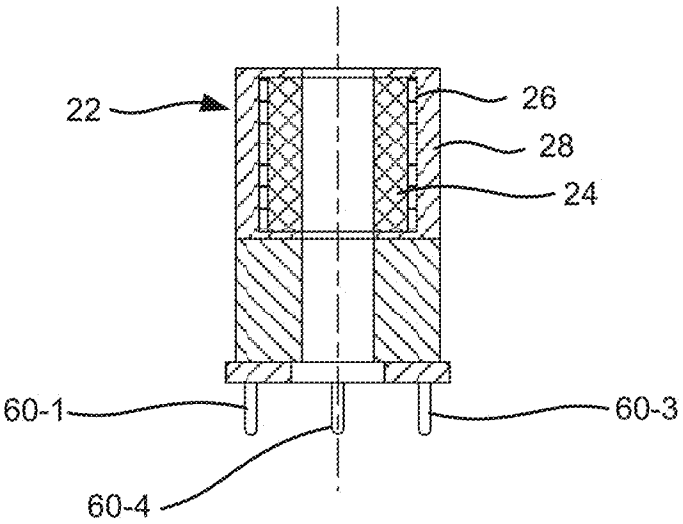
FIG. 6 is a schematic cross-sectional diagram illustrating a magnetic actuating component of the relay assembly of FIG. 1.

FIG. 6 is a schematic cross-sectional diagram illustrating a magnetic actuating component 22 of relay assembly 100. Magnetic actuating component 22 may be included in switch body 10 within coil housing 20. As shown in FIG. 6, magnetic actuating component 22 may include an inner coil 24, and an outer coil 26 in an encapsulant 28. Magnetic actuating component 22 may move internal switching components to selectively engage electrical contacts 40 (e.g., FIG. 4) and/or leads 60. Inner coil 24 and outer coil 26 may include high-temperature-resistant wires with a maximum operating temperature of at least 200 degrees C. In an exemplary implementation, coils 24 and 26 may both have a nominal voltage or 26.5 V.D.C. and a resistance of about 80 Ohms. Inner coil 24 may include an American Wire Gauge (AWG) wire size of 39 with 1400 turns, while outer coil 26 may include an AWG wire size of 41.5 with 525 turns. Encapsulant 28 may include a thermoset material, such as FIBERITE EPON Resin 9405, or a similar thermoset material. Encapsulant 28 may be cured and the assemble magnetic actuating component 22 may be inserted into coil housing 20 before adaptor sleeve 102 is slid over coil housing 20. It should be understood that coils 24 and 26 having other characteristics may be used based on the implementation.

Figure 7:
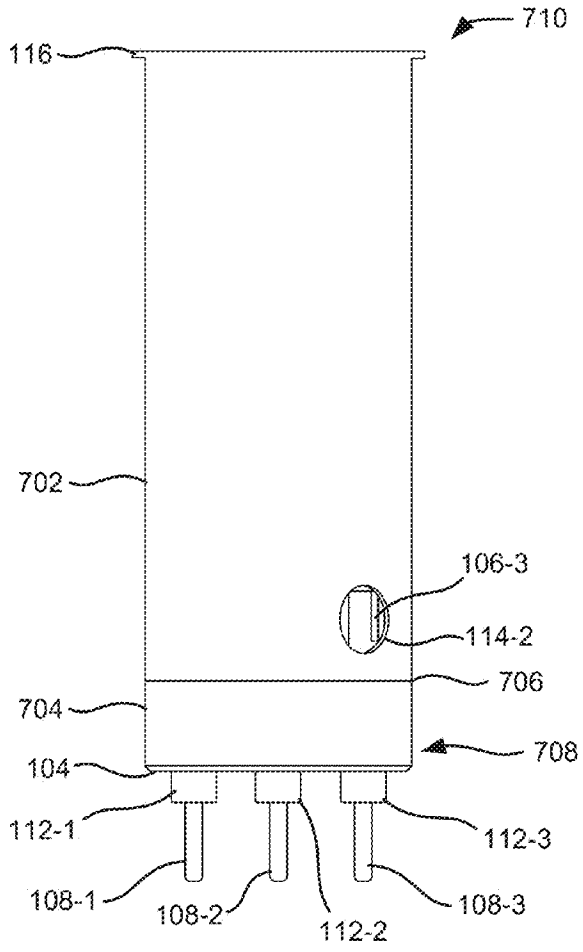
FIG. 7 is schematic side view of a reinforcing sheath assembly for a relay assembly, according to another implementation.

FIG. 7 is schematic side view of a reinforcing sheath assembly 710 for relay assembly 100, according to another implementation described herein. Reinforcing sheath assembly 710 includes an upper adaptor sleeve 702, a lower adaptor sleeve 704, feed-through base 104, multiple contacts 106, multiple conductors 108, multiple insulators 112, multiple apertures 114, and flange 116. Reinforcing sheath assembly 710 may be configured similar to reinforcing sheath assembly 110 described above, with the exception that upper adaptor sleeve 702 and lower adaptor sleeve 704 may be assembled separately and joined by a weld 706. Upper adaptor sleeve 702 may include apertures 114 and flange 116 in a configuration similar to that of adaptor sleeve 102 described above. Lower adaptor sleeve 704 may be joined to feed-through base 104 with contacts 106, conductors 108, and insulators 112 configured as described above in connection with, for example, FIGS. 2A-2B.

Thus, in the configuration of FIG. 7, lower adaptor sleeve 704 and feed-through base 104 may be assembled as a cup 708 including contacts 106, conductors 108, and insulators 112. Upper adaptor sleeve 702 may be attached at flange 116 to switch body 10 at flange 50 (e.g., similar to as shown in FIG. 1); contacts 108 may be aligned with and receive leads 60 from switch body 10; then cup 708 may be attached to the open end (e.g., the end opposite flange 116) of upper adaptor sleeve 702 as a separate weld process.

Figure 8:
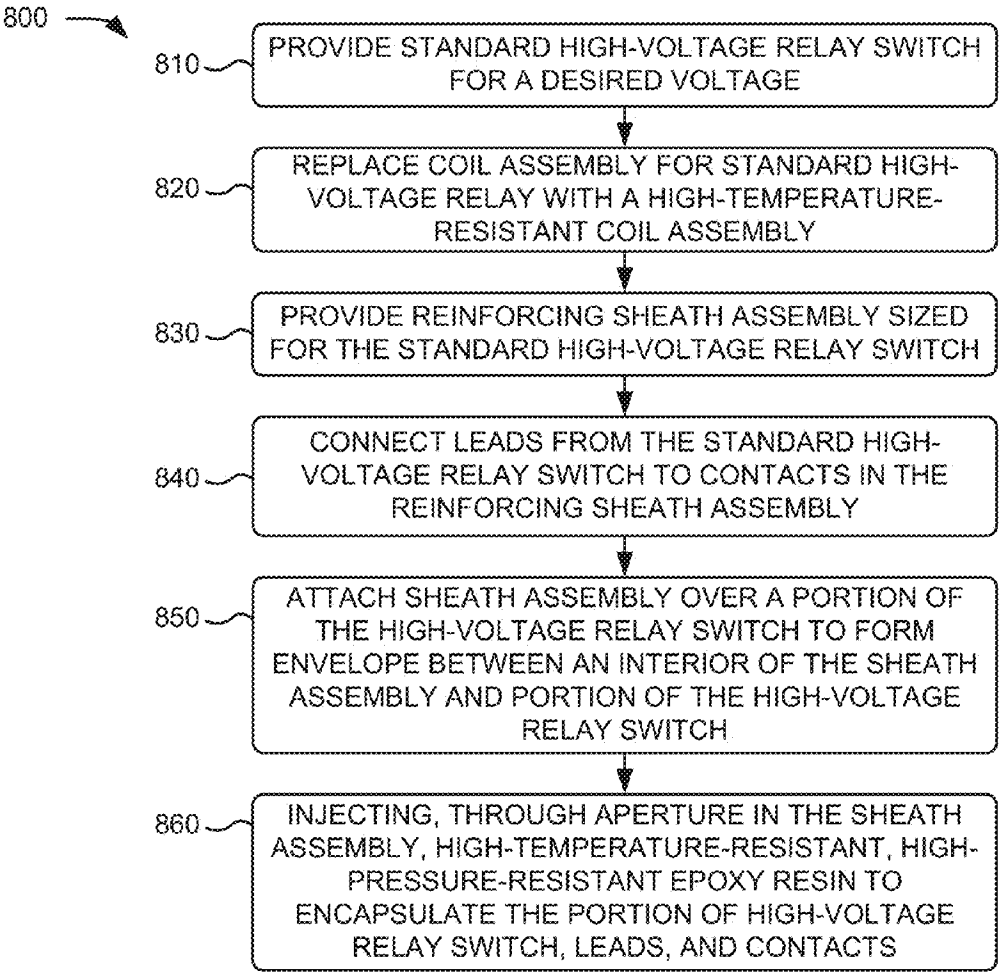
FIG. 8 is a flow diagram of an exemplary process for converting a standard high voltage vacuum relay into a high-temperature, high-pressure vacuum relay according to an implementation described herein.

FIG. 8 is a flow diagram of an exemplary process 800 for converting a standard high voltage vacuum relay into a high-temperature, high-pressure vacuum relay according to an implementation described herein. As shown in FIG. 8, process 800 may include providing a standard high-voltage relay switch for a desired voltage (block 810) and replacing a coil assembly for the standard high-voltage relay with a high-temperature-resistant coil assembly (block 820). For example, a high-voltage relay sized for a particular application, such as relay switch 10, may be selected. The standard coil assembly for the high-voltage relay may be replaced with magnetic actuating component 22 including inner coil 24 and outer coil 26 of high-temperature-resistant wires with a maximum operating temperature of at least 200 degrees C.

Process 800 may also include providing a reinforcing sheath assembly sized for the standard high-voltage relay switch (block 830), connecting leads from the standard high-voltage relay switch to contacts in the reinforcing sheath assembly (block 840), and attaching a sheath assembly over a portion of the high-voltage relay switch to form an envelope between an interior of the sheath assembly and the portion of the high-voltage relay switch (block 850). For example, sheath assembly 110 or sheath assembly 710 may be selected for the required physical dimensions (e.g., axial length, cylinder diameter, number/size of leads, etc.) of relay switch 10. Sheath assembly 110/710 may include a cylindrical adaptor sleeve (e.g., adaptor sleeve 102/upper adaptor sleeve 702) with apertures 114 in the wall of the adaptor sleeve. The cylindrical adaptor sleeve may also include feed-through base 104 that includes a set of conductors 108 with contacts 106. Sheath assembly 110/710 may be slid over an end of relay switch 10 to connect contacts 106 with leads 60. As shown, for example, in FIG. 5, an upper portion of sheath assembly may be connected (e.g., welded/brazed) at an interface of flanges 50 and 116. In another implementation, flanges 50 and 116 may be joined before contacts 106 are connected to leads 60 and feed-through base 104/cup 708 is joined to adaptor sleeve 102/upper adaptor sleeve 702. When sheath assembly 110/710 is secured to relay switch 10 an air envelope 118 is formed that is accessible through apertures 114.

Process 800 may further include injecting, through one of the apertures in the sheath assembly, high-temperature-resistant, high-pressure-resistant epoxy resin to encapsulate the portion of the high-voltage relay switch, the leads, and the contacts (block 860). For example, a thermoplastic polytherimide resin 120 may be injected through one of apertures 114. Air may exit through another of apertures 114 to permit a void-free encapsulation. When the thermoplastic polytherimide resin 120 is injected and cured within envelope 118, relay assembly 100 can operate at high temperatures (e.g., of at least 200 degrees C.) and high pressures (e.g., of at least 25,000 psi).

Figure 9B:
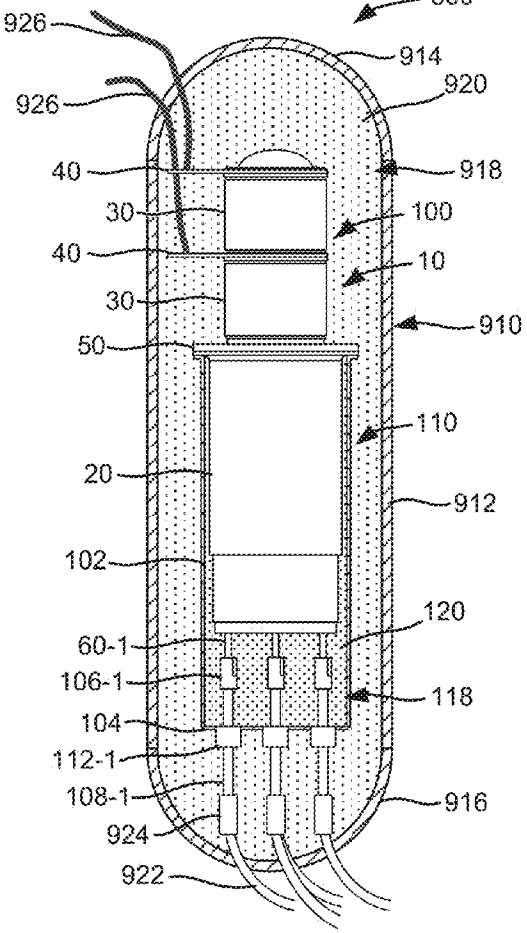
FIGS. 9A and 9B are a schematic side perspective view and a schematic partial cross-sectional diagram of a high-temperature, high-pressure vacuum relay assembly according to another implementation described herein.
Figure 9A:
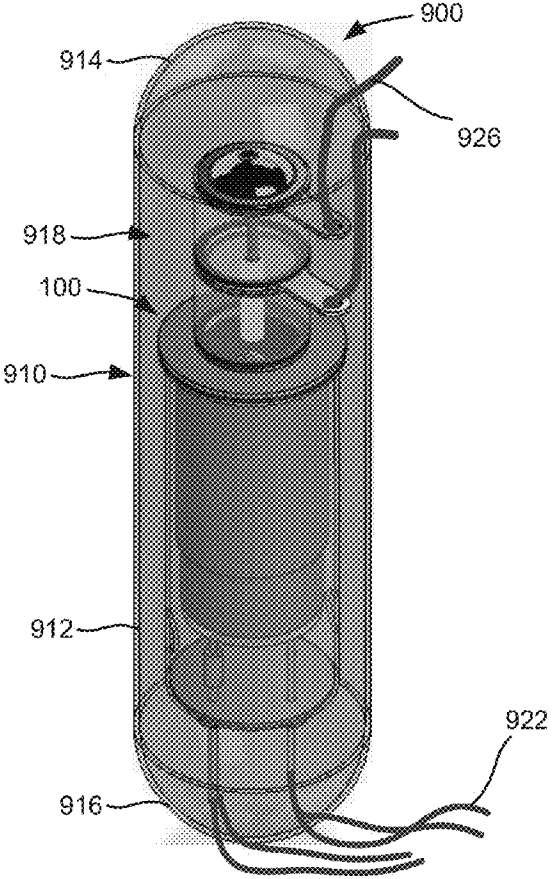

FIGS. 9A and 9B are a schematic side perspective view and a schematic partial cross-sectional diagram of a high-temperature, high-pressure vacuum relay assembly 900 according to another implementation described herein. Referring collectively to FIGS. 9A and 9B, in one implementation, relay assembly 900 may include all the components of relay assembly 100 within an enclosure 910. Enclosure 910 may include, for example, a cylindrical tube 912 enclosed at both ends with endcaps 914 and 916. Other shapes for enclosure 910 may be used.

Enclosure 910 may be made from a heat-resistant plastic material, such as a thermoplastic material that is resistant to deformation at temperatures of up to 200 degrees Celsius (C). In one implementation, enclosure 910 may be molded from the same material as (or a similar material to) that of thermoplastic polytherimide resin 120. Tube 912, endcap 914, and endcap 916 may be made from the same material or different materials. In one implementation, endcaps 914 and 916 may be secured to tube 912, such as via a threaded connection, bonding, welding, etc.

Enclosure 910 may form an envelope 918 around relay assembly 100. According to an implementation, envelope 918 may be filled with epoxy resin(s) cured to form a thermoset polymer 920. Particularly, thermoset polymer 920 may surround conductors 108, insulators 112, and contacts 40 inside envelope 918. In some implementations, one or more of tube 912, endcap 914, or endcap 916 may include a port to receive the epoxy resin. In other implementations, one or more of endcap 914 or endcap 916 may be secured to tube 912 after the addition of the epoxy resin for thermoset polymer 920.

As shown in FIG. 9B, coil wires 922 may protrude through enclosure 910 (e.g., endcap 916) and attach to conductors 108 at connectors 924. Thus, connectors 924 and a portion of coil wires 922 may also be encapsulated in thermoset polymer 920 inside envelope 918. Similarly, wires 926 may be connected to contacts 40 so that a portion of wires 926 and contacts 40 may be encapsulated in thermoset polymer 920 inside envelope 918. In one implementation, pass-through holes (not labeled) may be drilled through a portion of enclosure 910 for wires 922/926 to pass through. Coil wires 922 may be connected to conductors 108 and wires 926 may be connected to contacts 40 prior to insertion of the epoxy resin for thermoset polymer 920 into envelope 118.

Figure 10:
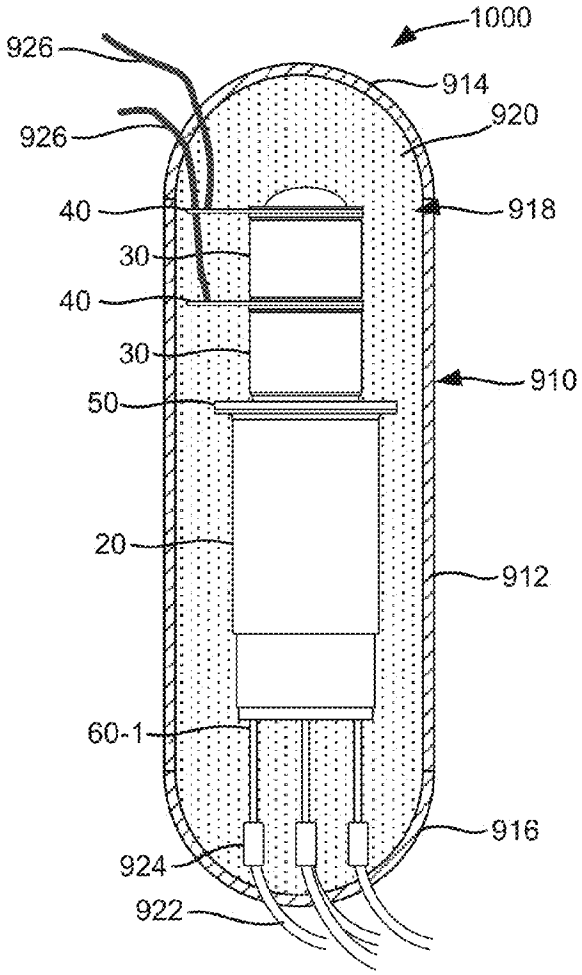
FIG. 10 is a schematic partial cross-sectional diagram of a high-temperature, high-pressure vacuum relay assembly according to still another implementation described herein.

In one implementation, enclosure 910 may be applied to relay assembly 100 after completion, for example, of the steps of process 800. In another implementation, as shown in FIG. 10, enclosure 910 and thermoset polymer 920 may be applied over switch body 10 without the use of reinforcing sheath assembly 110. In this implementation, leads 60 may be connected directly to coil wires 922 (e.g., via connectors 924), such that adaptor sleeve 102, feed-through base 104, contacts 106, conductors 108, insulators 112, and resin 120 may be eliminated from the configuration shown in FIGS. 9A and 9B.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein have been described with respect to high-temperature, high-pressure environments. In other cases, implementations may also be used in conjunction with other devices and environments, such as medium or low voltage equipment and/or medium/low-temperature environments or medium/low-pressure environments.

Implementations have been described herein primarily in the context of converting a standard relay switch to one suited for high-temperature, high-pressure environments. In other implementations, a similar relay switch for high-temperature, high-pressure environments may be manufactured as an originally manufactured component.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A relay assembly, comprising:

a switch body including a substantially cylindrical housing to house a coil and other internal switching components, wherein the switch body includes:

a flange extending orthogonally from a portion of the housing, and multiple leads extending from an end of the cylindrical housing;

a substantially cylindrical adaptor sleeve with one or more openings in a wall of the sleeve, wherein a first end of the adaptor sleeve encircles at least a portion of the switch body and is attached to the flange;

a feed-through base, attached to a second end of the adaptor sleeve to enclose the second end of the adaptor sleeve, wherein the feed-through base includes:

multiple holes through which conductors extend from inside the adaptor sleeve to outside the adaptor sleeve, multiple contacts, inside the adaptor sleeve, joining each conductor to one of the multiple leads, and multiple insulators, adjacent to each of the multiple holes, through which each conductor extends, wherein the flange, the adaptor sleeve, and the feed-through base form an envelope around the portion of the housing, the multiple contacts, and the multiple leads; and a resin encapsulating the portion of the housing, the multiple contacts, and the multiple leads within the envelope.

2. The relay assembly of claim 1, wherein the resin includes a thermoplastic polytherimide resin.

3. The relay assembly of claim 1, wherein the relay assembly is configured to remain operational at an atmospheric pressure of at least 25,000 pounds per square inch (PSI).

4. The relay assembly of claim 1, wherein the relay assembly remains operational at a temperature of up to 200° C.

5. The relay assembly of claim 1, wherein the resin further encapsulates a portion of each conductor.

6. The relay assembly of claim 1, wherein the resin encapsulating the portion of the housing, the multiple contacts, and the multiple leads is free of voids within the envelope.

7. The relay assembly of claim 1, wherein the adaptor sleeve consists of a stainless steel.

8. The relay assembly of claim 1, wherein the feed-through base includes a stainless steel disc joined to the second end of the adaptor sleeve.

9. The relay assembly of claim 8, wherein the multiple insulators include a ceramic material brazed to the stainless steel disc.

10. The relay assembly of claim 1, wherein each of the multiple contacts are configured to have a wiping fit on one of the multiple leads.

11. The relay assembly of claim 1, further comprising:

an enclosure that surrounds the switch body, the adaptor sleeve, and the feed-through base, wherein the enclosure forms an envelope around the feed-through base; and a thermoset polymer that encapsulates the switch body, the adaptor sleeve, and the feed-through base.

12. A reinforcing sheath for a high-voltage relay switch, comprising:

a substantially cylindrical adaptor sleeve with one or more openings in a wall of the sleeve, wherein a first end of the adaptor sleeve has a diameter sized to encircle at least a portion of the high-voltage relay switch and attach to a flange of the high-voltage relay switch; and a feed-through base, attached to a second end of the adaptor sleeve to enclose the second end of the adaptor sleeve, wherein the feed-through base includes:

multiple holes through which conductors extend from inside the adaptor sleeve to outside the adaptor sleeve, multiple contacts, inside the adaptor sleeve, joining each conductor to one of multiple leads extending from the high-voltage relay switch, and multiple insulators, adjacent to each of the multiple holes, through which each conductor extends, wherein the reinforcing sheath, when attached to the flange, forms an envelope around the portion of the high-voltage relay switch, the multiple contacts, and the multiple leads, and wherein the envelope provides an area to encapsulate the portion of the relay switch, the multiple contacts, and the multiple leads in an epoxy resin within the envelope.

13. The reinforcing sheath of claim 12, wherein the epoxy resin includes a thermoplastic polytherimide resin.

14. The reinforcing sheath of claim 13, wherein the reinforcing sheath and the epoxy resin protect the high-voltage relay switch so as to remain operational at an atmospheric pressure of 25,000 pounds per square inch (PSI).

15. The reinforcing sheath of claim 12, wherein the resin further encapsulates a portion of each conductor.

16. The reinforcing sheath of claim 12, wherein the adaptor sleeve consists of a stainless steel.

17. The reinforcing sheath of claim 12, wherein the feed-through base includes a stainless steel disc joined to the second end of the adaptor sleeve.

18. The reinforcing sheath of claim 17, wherein the multiple insulators include a ceramic material brazed to the stainless steel disc.

19. A method, comprising:

providing a standard high-voltage relay switch for a desired voltage rating;

replacing a coil assembly of the standard high-voltage relay switch with a high-temperature-resistant coil assembly;

providing a reinforcing sheath assembly sized for the standard high-voltage relay switch;

connecting leads from the standard high-voltage relay switch to contacts in the reinforcing sheath assembly;

attaching the sheath assembly over a portion of the standard high-voltage relay switch to form an envelope between an interior of the sheath assembly and the high-temperature-resistant coil assembly; and injecting, through an aperture in the sheath assembly, a high-temperature-resistant, high-pressure-resistant epoxy resin to encapsulate the high-temperature-resistant coil assembly, the leads, and the contacts.

20. The method of claim 19, further comprising:

providing an enclosure that surrounds the standard high-voltage relay switch and the sheath assembly, wherein the enclosure forms another envelope around the standard high-voltage relay switch and the sheath assembly;

connecting, to the contacts in the reinforcing sheath assembly, wires that protrude through the enclosure; and injecting, through an opening in the enclosure and into the other envelope, resin for a thermoset polymer that encapsulates the standard high-voltage relay switch and the sheath assembly.

* * * * *